US008490714B2

(12) United States Patent
Nakamura

(10) Patent No.: US 8,490,714 B2
(45) Date of Patent: Jul. 23, 2013

(54) IMPACT WRENCH

(75) Inventor: Akinori Nakamura, Osaka (JP)

(73) Assignee: Kuken Co., Ltd., Osaka (JP)

( * ) Notice: Subject to any disclaimer, the term of this patent is extended or adjusted under 35 U.S.C. 154(b) by 0 days.

(21) Appl. No.: 13/297,430

(22) Filed: Nov. 16, 2011

(65) Prior Publication Data

US 2012/0073845 A1 Mar. 29, 2012

Related U.S. Application Data

(63) Continuation of application No. PCT/JP2009/065422, filed on Sep. 3, 2009.

(30) Foreign Application Priority Data

Jun. 3, 2009 (JP) ..... 2009-0133997

(51) Int. Cl.
*B25D 11/04* (2006.01)

(52) U.S. Cl.
USPC ..... 173/93; 173/93.5

(58) Field of Classification Search
USPC ..... 173/48, 93, 93.5, 93.6
See application file for complete search history.

(56) References Cited

U.S. PATENT DOCUMENTS 4,313,505 A * 2/1982 Silvern ..... 173/93.5
2001/0010268 A1* 8/2001 Tokunaga et al. ..... 173/205
2006/0024141 A1* 2/2006 Schad ..... 408/8

* cited by examiner

*Primary Examiner* — Alexandra Elve
*Assistant Examiner* — Nathaniel Chukwurah
(74) *Attorney, Agent, or Firm* — Robert P. Michal; Lucas & Mercanti, LLP

(57) ABSTRACT

An impact wrench is provided that can mitigate vibrations in the axial direction without reducing the rotary impact force of hammers. The hammers are composed of a primary hammer fitted to the outer circumference of a spindle and a cylindrical secondary hammer that is disposed so as to cover the primary hammer and that rotates integrally with the primary hammer. Furthermore, the secondary hammer is held by a center holding means in a state in which the rotational axis of the secondary hammer is coincident with the axis of the spindle in order to prevent run-out movement. With the use of the hammer configuration of the present invention, the mass of the primary hammer can be decreased compared to that of the secondary hammer, and therefore it is possible to mitigate vibrations in the axial direction while maintaining the rotary impact force.

16 Claims, 6 Drawing Sheets

IMPACT WRENCH

CROSS-REFERENCE TO RELATED APPLICATION

This is a Continuation of PCT International Application PCT/JP2009/065422 filed Sep. 3, 2009, which in turn claims benefit to Japanese Patent Application No. JP 2009-0133997 filed Jun. 3, 2009, the entire disclosure of each of which is incorporated herein by reference.

TECHNICAL FIELD

The present invention relates to an impact wrench configured to tighten bolts, nuts, and the like firmly by applying an impact in the rotational direction.

BACKGROUND ART

An impact wrench is configured to tighten bolts, nuts, and the like by applying impulsive force generated by a rotationally driven hammer to an anvil serving as an output shaft. An impact wrench is provided with a motor, a spindle, a hammer, and an anvil as its main components. The operation will now be described briefly below.

The motor causes the spindle to rotate at a predetermined number of revolutions, and the rotational force of the spindle is transmitted to the hammer. Rotation of the hammer causes claws provided on the hammer to strike engaging claws provided on the anvil. Then, this impact provides a predetermined torque to a socket attached at the tip of the anvil, thus tightening bolts, nuts, and the like.

Such impact wrenches as described above can be classified into several groups according to their different mechanisms that deliver a rotary impact. A typical impact wrench is one whose rotary impact mechanism is configured by cam grooves that are formed in the spindle and the hammer, steel balls sandwiched between the cam grooves, and a spring that biases the hammer in the direction of the anvil (see, for example, Patent Document 1).

In the impact wrench described in Patent Document 1, the hammer, in principle, moves in the direction of the axis of the spindle while rotating. Consequently, an impulse is applied in the axial direction in addition to an impulse that causes rotation of bolts, nuts, and the like, and these impulses cause vibrations in a direction orthogonal to the axis of the spindle and in the direction of the axis of the spindle. The vibrations cause fatigue to the worker and hence reduced operation efficiency as well as numbness in the hand, and therefore it is desired to mitigate the vibrations.

The result of a measurement of the vibrations indicates that the magnitude of vibrations in the direction of the axis of the spindle is about three times that of vibrations in the direction orthogonal to the axis of the spindle, and it is effective to reduce the vibrations in the direction of the axis of the spindle in mitigating vibrations.

As means for mitigating the vibrations in the direction of the axis of the impact wrench, it is conceivable to decrease the mass of a primary hammer, which is the source of the vibrations in the axial direction, by providing a secondary hammer that only contributes to transmission of an impulse in the rotational direction, separately from the primary hammer. However, no specific proposal has been made.

Although the purpose is different from the mitigation of the vibrations in the axial direction, it has been proposed to provide a secondary hammer that only contributes to transmission of an impulse in the rotational direction in order to regulate the rotary impact force of the hammers, and engage or disengage the secondary hammer with or from the primary hammer (see, for example, Patent Document 1, Patent Document 2).

Citation List

Patent document 1: JP 2007-152448A
Patent document 2: JP 6-190741A

DISCLOSURE OF INVENTION

Problem to be Solved by the Invention

The structures proposed in these patent documents, however, cannot be directly used as means for mitigating the vibrations in the axial direction. The reasons are as described below.

One reason is that a primary hammer with a small mass cannot be used To reduce the vibrations in the axial direction resulting from the primary hammer, it is necessary to reduce the impulsive force in the axial direction. Also, the magnitude of the impulsive force in the axial direction is proportional to the mass of the primary hammer. Accordingly, in order to reduce the impulsive force in the axial direction, it is necessary to minimize the mass of the primary hammer compared to the secondary hammer.

However, it is necessary to secure a sufficiently large impulsive force in the rotational direction for the primary hammers disclosed in the patent documents (the hammer 4 in Patent Document 1, the hammer 2 in Patent Document 2) such that they can tighten bolts, nuts, and the like by themselves. Also, the magnitude of the impulsive force in the rotational direction is proportional to the moment of inertia of the primary hammer. Note that moment of inertia is the integral of the product of the mass of each portion of an object and the square of its distance to the rotational shaft over the object.

The primary hammers disclosed in the patent documents are each disposed such that the engageable/disengageable secondary hammer surrounds the primary hammer, and therefore it is not possible to increase the distance from each portion of the primary hammer to the rotational shaft. For this reason, to achieve a sufficiently large moment of inertia, the mass of the primary hammer must be large in the vicinity of the rotational shaft. Consequently, the primary hammer has a large mass, and therefore vibrations in the axial direction cannot be significantly reduced.

A second reason is that no means for holding the rotational axis of the secondary hammer is provided. The outer circumferential face of the primary hammer and the inner circumferential face of the secondary hammer are splined, so that the primary hammer and the secondary hammer rotate together by their teeth meshing with each other. However, in each of the structures disclosed in the patent documents, a large gap (play) is provided between the secondary hammer and the primary hammer so as to allow the secondary hammer (the additional hammer 8 in Patent Document 1, the additional hammer 6 in Patent Document 2) to be moved smoothly from the disengaged position to the position of engagement with the primary hammer by a manual operation. Accordingly, the rotational axis of the secondary hammer cannot be held by the primary hammer.

Furthermore, in each of the structures disclosed in the patent documents, no other means for holding the rotational axis of the secondary hammer is provided. Consequently, when the primary hammer moves in the axial direction with rotation of the spindle in a state in which the secondary hammer is engaged with the primary hammer, the rotational axis of the secondary hammer becomes displaced with respect to the rotational axis of the spindle, resulting in the so-called "precession rotation". Precession rotation impedes smooth movement of the primary hammer in the axial direction, thus causing a reduction in the rotary impact force generated by hammers.

The present invention has been made in view of such conventional problems, and it is an object of the invention to provide an impact wrench that can mitigate vibrations in the axial direction without reducing the rotary impact force generated by the hammers.

Means for Solving Problem

An impact wrench according to the present invention for achieving the foregoing object is an impact wrench including:

a columnar spindle that can be rotated by a motor;

an anvil that is disposed forward in the direction of a rotational axis of the spindle and whose rotational axis is coincident with said axis of the spindle, the anvil including, at a front portion thereof, a square end to which a tightening socket can be mounted or a hole into which a driver bit can be inserted, and including a first claw at a rear portion thereof;

a primary hammer that can be fitted to an outer circumference of the spindle and that includes, at a front portion thereof, a second claw for engagement with the first claw, the primary hammer being capable of rotating about the rotational axis of the spindle and of moving in the direction of said axis;

a secondary hammer including a cylindrical portion that rotates together with the primary hammer, the cylindrical portion having an internal space into which the spindle can be inserted and in which the primary hammer can be housed;

a rotary impact mechanism that is interposed between the spindle and the primary hammer, that causes, when a torque greater than a predetermined value is exerted between the spindle and the primary hammer, the primary hammer to rotate and advance in the direction of the anvil, and that strikes the first claw by engaging impulsively the second claw with the first claw, thereby causing the anvil to rotate about an axis; and a axis holding means that holds the rotational axis of the secondary hammer in coincidence with the rotational axis of the spindle.

Here, a bottomed cylindrical secondary hammer in which a bottom portion is formed at a rear end portion of the cylindrical portion may be used as the secondary hammer, and an opening for insertion of the spindle that is formed at the center of the bottom portion may have an inside diameter that is substantially equal to an outside diameter of the spindle, so that the bottom portion of the secondary hammer functions as the axis holding means.

The spindle and the secondary hammer may be rotatably supported on a case in a state in which axes of the spindle and the secondary hammer are coincident and via a first bearing and a second bearing, respectively, so that the case functions as the axis holding means. Preferably, the first bearing and the second bearing may be attached to an inner circumferential face of a cylindrical bush and the bush may be fixed to the case.

An inner circumferential face of the cylindrical portion of the secondary hammer may be rotatably supported by an outer circumferential face of at least two first claws provided at the anvil, so that the at least two first claws of the anvil function as the axis holding means.

An inner circumferential face of the cylindrical portion of the secondary hammer may be supported directly or via a bearing by a ring-shaped flange provided at the rear portion of the anvil, so that the flange functions as the axis holding means.

In the impact wrench according to the present invention, it is preferable that a plurality of first grooves that have a semi-circular cross-sectional shape and are parallel to the axis of the spindle are formed on an outer circumferential face of the primary hammer, a plurality of second grooves that have a semi-circular cross-sectional shape and are parallel to the axis of the spindle are formed on an inner circumferential face of the cylindrical portion of the secondary hammer at positions corresponding to the first grooves, and a columnar member is fitted in each of the first grooves and the second grooves.

Note that the internal space of the cylindrical portion of the secondary hammer may be configured to be sealed by the bottom portion of the secondary hammer, a ring-shaped flange formed at the rear portion of the anvil, and a ring-shaped cover disposed between a front open end of the cylindrical portion of the secondary hammer and the flange.

Preferably, a spring that biases the primary hammer in the direction of the anvil is disposed between the bottom portion of the secondary hammer and the primary hammer.

Preferably, a plurality of balls for rotatably supporting the secondary hammer on the case and a ring-shaped ball guide for guiding the balls are disposed at a rear end portion of the secondary hammer, and a ring-shaped first cushioning member for absorbing shock is disposed between the secondary hammer and the ball guide.

Preferably, a ring-shaped second cushioning member for absorbing shock is disposed between a stepped portion formed at the front portion of the spindle and a rear end portion of the anvil.

Effects of the Invention

According to the present invention, a cylindrical secondary hammer is used, the secondary hammer rotates together with a primary hammer, and the primary hammer is housed in the internal space of the cylindrical portion of the secondary hammer. Thereby, the length of the secondary hammer in the axial direction can be increased, thus enabling the mass of the secondary hammer to be increased compared to the primary hammer. Moreover, the precession rotation is prevented by making the rotational axis of the secondary hammer coincident with the axis of the spindle by the axis holding means.

Consequently, it is possible to decrease the mass of the primary hammer compared to the secondary hammer and mitigate the vibrations in the direction of the axis of the spindle while maintaining the rotary impact force. Accordingly, it is possible to reduce the fatigue of the worker and prevent a reduction in the operation efficiency and the occurrence of numbness. Furthermore, the use of the cylindrical secondary hammer enables the moment of inertia to be increased, and therefore a strong rotary impact force can be achieved.

DESCRIPTION OF THE INVENTION

Hereinafter, impact wrenches according to embodiments of the present invention will be described with reference to the drawings.

(Embodiment 1)

Figure 1:
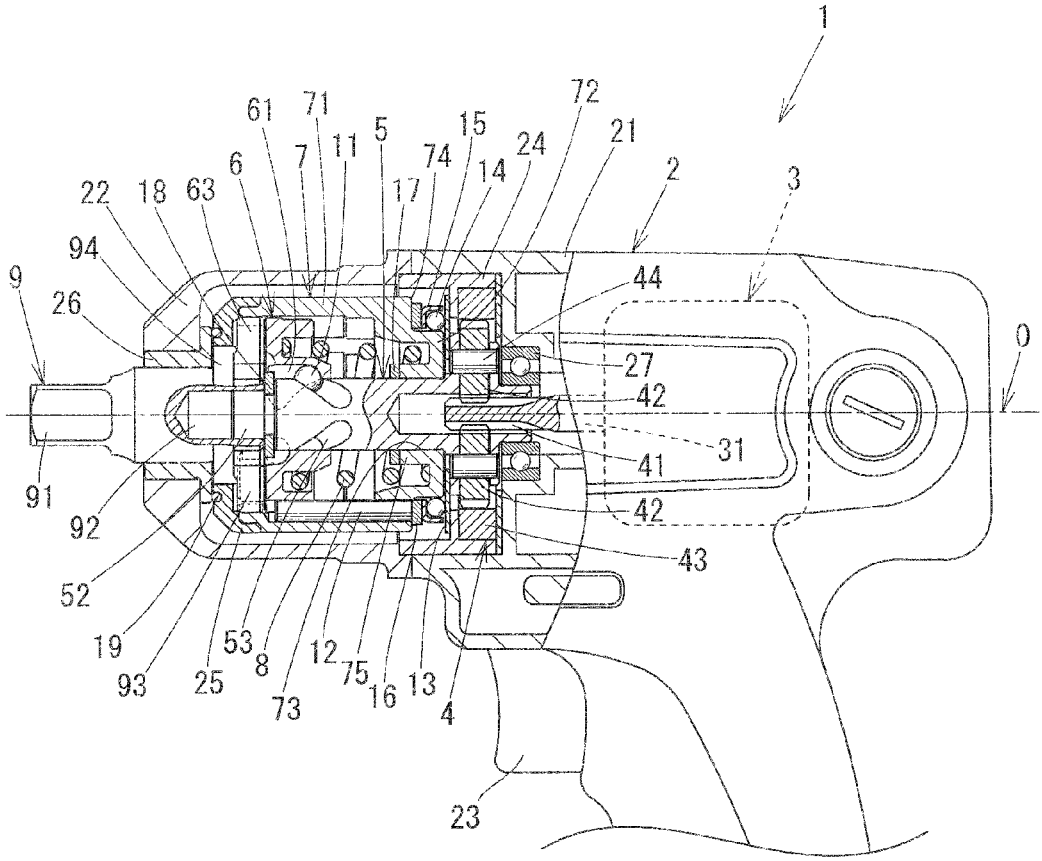
FIG. 1 is an elevation showing principal parts of an impact wrench according to Embodiment 1 of the present invention, cut in a longitudinal plane including the axis of a spindle.
Figure 2:
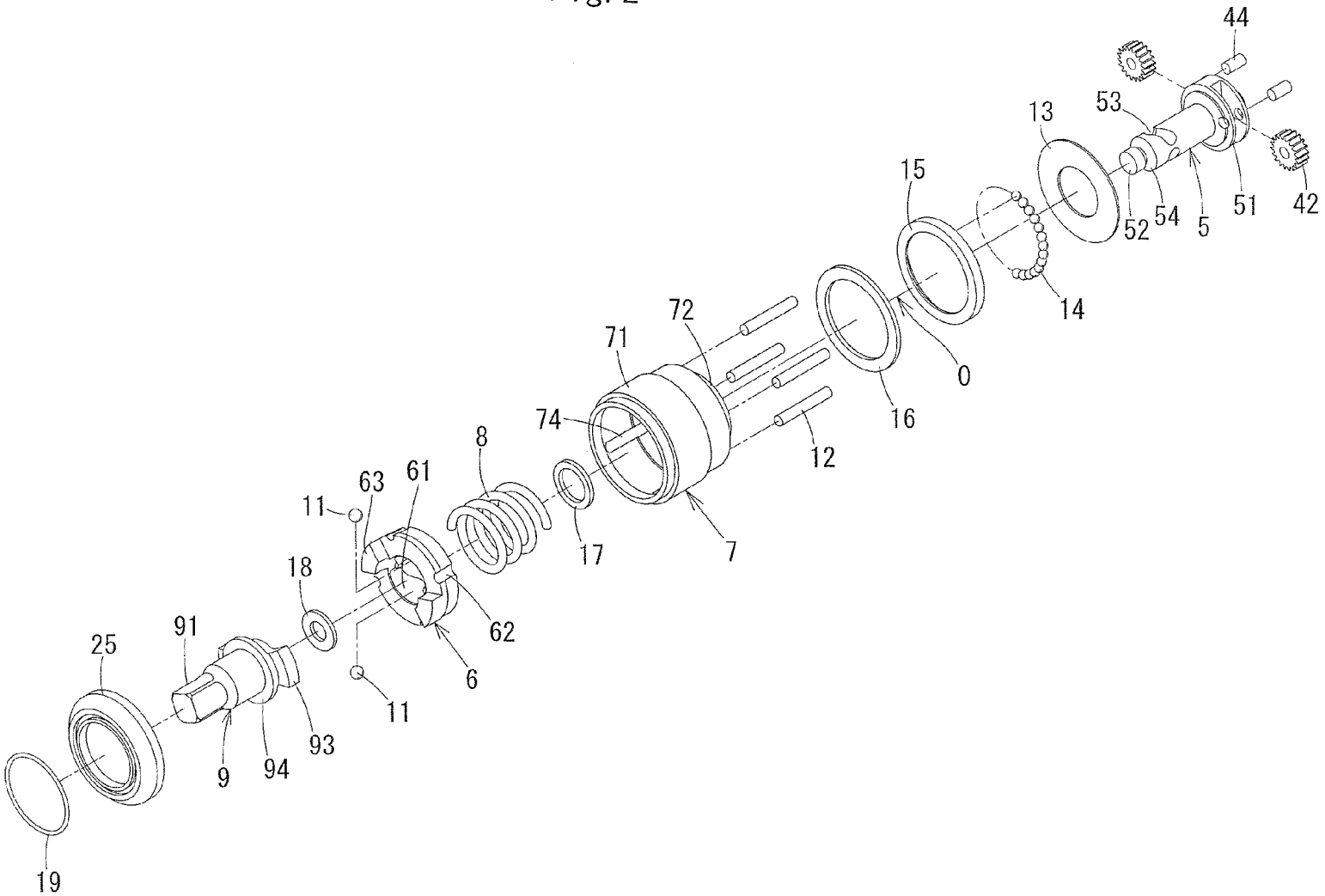
FIG. 2 is an exploded perspective view showing the components of the impact wrench according to Embodiment 1, excluding the case portion thereof FIG. 3 each show a plane (half of the circumference of the circle) obtained by circumferentially developing the outer circumferential face of the spindle and the inner circumferential face of a primary hammer of the impact wrench shown in FIG. 1.

FIG. 1 is an elevation showing principal parts of an impact wrench according to Embodiment 1 of the present invention, cut in a longitudinal plane including the axis of a spindle. FIG. 2 is an exploded perspective view showing the components of the impact wrench shown in FIG. 1, excluding the case portion thereof.

<Configuration of Impact Wrench>

An impact wrench 1 includes a case 2, an electric motor 3, a rotation transmission mechanism 4, a spindle 5, a primary hammer 6, a secondary hammer 7, a spring 8, and an anvil 9. The structure and function of each of the components will be described below.

First, the case 2 will be described. The case 2 is composed of a resin housing 21 disposed in the rear portion of the impact wrench 1 and an aluminum clutch case 22 disposed in the front portion, and the clutch case 22 is fixed to the housing 21 by screws, which are not shown. The following description is given, taking the side where the anvil 9 is disposed as the front and the side where the electric motor 3 is disposed as the rear.

The housing 21 houses, for example, the electric motor 3, the rotation transmission mechanism 4 and a battery. Provided below the housing 21 are a lever 23 serving as the switch of the electric motor 3, as well as an operator grip and a battery housing portion for housing the battery serving as the power source for the electric motor 3, which are not shown.

Meanwhile, the clutch case 22 houses, for example, the primary hammer 6, the secondary hammer 7, and the anvil 9, which are the main components of the impact wrench 1. A square end 91 of the anvil 9 projects from an opening formed in the front portion.

Next, the rotation transmission mechanism 4 will be described. Rotation of a rotational shaft 31 of the electric motor 3 is transmitted via the rotation transmission mechanism 4 to the steel spindle 5. The rotation transmission mechanism 4 is composed of a sun gear 41 fixed to the rotational shaft 31 of the electric motor 3, two planetary gears 42 for meshing with the sun gear 41, and an internal gear 43 for meshing with the planetary gears 42. As shown in FIG. 2, the planetary gears 42 are each supported by a support shaft 44 that is attached rotatably to a bulged portion 51 formed at the rear of the spindle 5.

A bush 24 in which a ring-shaped flange is formed on the inner circumference of a cylinder is disposed at the front of the rotation transmission mechanism 4, and the internal gear 43 is fixed to the housing 21 with the bush 24.

Next, the spindle 5 will be described. As shown in FIG. 1, the columnar spindle 5 is attached rotatably to the housing 21 via a ball bearing 27 disposed at the rear end portion. The bulged portion 51, which has two ring-shaped collars disposed at a predetermined interval, is formed at the front of the ball bearing 27. As described above, the two planetary gears 42 supported by the support shafts 44 are disposed in the rotatable state between the two collars of the bulged portion 51.

As shown in FIG. 2, at the tip of the spindle 5, a columnar projecting portion 52 having a smaller diameter is formed coaxially with the body portions of the spindle 5 (the bulged portion 51 and a columnar portion having cam grooves 53 described below), and the projecting portion 52 is fitted in the rotatable state to a hole 92 that is formed in the rear portion of the anvil 9 and has a columnar internal space. Note that the hole 92 is worked so as to be coaxial with the columnar portion located behind the square end 91, which will be described below, of the anvil 9.

Next, the primary hammer 6 will be described. The steel primary hammer 6, which has a through hole formed at its center, is fitted to the outer circumference of the spindle 5. As shown in FIG. 2, a pair of claws 63 projecting toward the anvil 9 are provided on the front end face of the primary hammer 6.

Figure 3A:
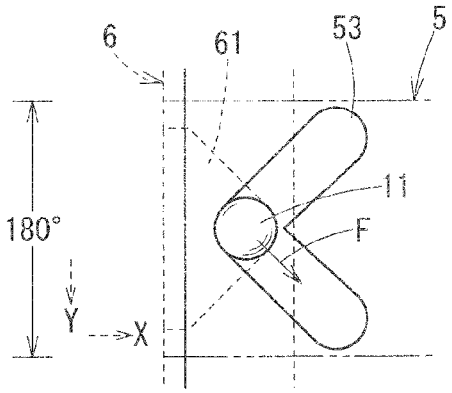
Figure 3B:
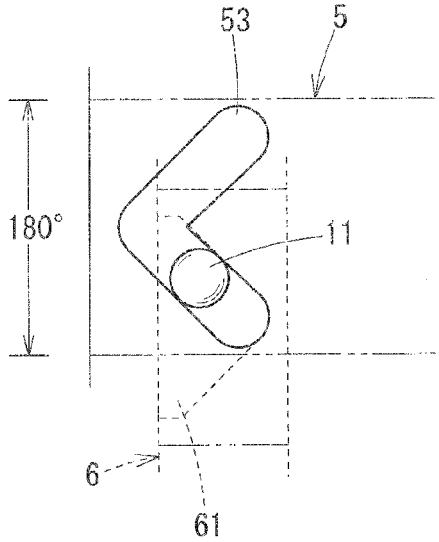

A mechanism that applies a rotary impact to the anvil 9 (hereinafter, referred to as "rotary impact mechanism") is provided between the primary hammer 6 and the spindle 5. Specifically, the rotary impact mechanism is composed of two cam grooves 53 formed on the outer circumferential face of the spindle 5, two cam grooves 61 formed on the inner circumferential face of the through hole of the primary hammer 6, two steel balls 11 disposed so as to be sandwiched between each cam groove 53 and each cam groove 61, and the spring 8 that biases the primary hammer 6 in the direction of the anvil 9. FIG. 3 each show a plane obtained by circumferentially developing the outer circumferential face of the spindle 5 and the inner circumferential face of the through hole of the primary hammer 6 for half (180°) of the circumference of the circle.

As can be seen from FIG. 3, the cam grooves 53 of the spindle 5 are formed in a V-shape, and the end portion of the cam grooves 61 of the primary hammer 6 is formed in an inversed V-shape. The steel balls 11 can move along the cam grooves 53 and the cam grooves 61. Movement of the steel balls 11 along the cam grooves 53 and the cam grooves 61 allows the primary hammer 6 to rotate while moving forward or backward on the outer circumferential face of the spindle 5 along the rotational axis O of the spindle 5 (hereinafter, abbreviated as "the axis of the spindle 5"). The details of the operation of the rotary impact mechanism will be described later with reference to FIG. 3.

Next, the secondary hammer 7 will be described. As shown in FIG. 1, the bottomed cylindrical steel secondary hammer 7 is disposed on the outer circumferential side of the primary hammer 6. The secondary hammer 7 is composed of a cylindrical portion 71 and a bottom portion 72 provided at the rear end portion of the cylindrical portion 71, and an opening 73 through which the spindle 5 passes is formed at the center of the bottom portion 72.

As shown in FIG. 2, grooves 62 having a semi-circular cross-sectional shape are formed parallel to the axis O in four positions of the outer circumferential face of the primary hammer 6. Likewise, grooves 74 having a semi-circular cross-sectional shape are formed parallel to the axis O in four positions of the inner circumferential face of the cylindrical portion 71 of the secondary hammer 7. Also, needle rollers 12, which are columnar members, are fitted in the grooves 62 and the grooves 74.

When there is no means for holding the rotational axis of the secondary hammer 7, each of the rotational axes of the primary hammer 6 and the secondary hammer 7 does not necessarily coincide with the axis O. However, in a state in which the needle rollers 12 are fitted, the hammers rotate together about a certain common rotational axis. Then, the primary hammer 6 can move in the forward or backward direction with the needle rollers 12 as the guide. Note that in FIG. 1, the needle roller 12 and the grooves 62 and 74 were depicted only in the lower portion for the sake of simplicity of description of the cross-sectional shape, and illustration of the needle rollers 12 and the grooves 62 and 74 in the upper portion is omitted.

A stepped portion 74 is formed on the outer circumferential side of the bottom portion 72 of the secondary hammer 7, and a ring-shaped washer 13, a plurality of steel balls 14, and a ball guide 15 with a flange are provided between the bush 24 and the stepped portion 74. The action of the balls 14 allows the secondary hammer 7 to freely rotate on the bush 24. On the other hand, the front open end of the cylindrical portion 71 of the secondary hammer 7 is covered with a ring-shaped cover 25.

The spring 8 is interposed between the rear portion of the primary hammer 6 and the bottom portion 72 of the secondary hammer 7. The spring 8 is a compression spring commonly called a coil spring, and biases the primary hammer 6 toward the anvil 9. The primary hammer 6, the secondary hammer 7, and the spring 8 rotate together about the axis O. By receiving the rear end of the spring 8 by the bottom portion 72 of the secondary hammer 7 in this way, no anti-torsion washer or balls, which are required when the spring 8 is directly received by the housing 21, are needed, which simplifies the configuration of the rotary impact mechanism.

Next, the anvil 9 will be described. As shown in FIG. 1, the steel anvil 9 is rotatably supported on the clutch case 22 via a steel or brass slide bearing 26. The square end 91 having a square cross-sectional shape for attachment of a socket mounted to the head of a hexagon head bolt, a hexagon nut, or the like is provided at the tip of the anvil 9. The square end 91 projects from an opening formed in the clutch case 22.

A pair of claws 93 for engagement with the claws 63 of the primary hammer 6 are provided at the rear portion of the anvil 9. The pair of claws 93 are each formed in the shape of a fan (see FIG. 2), and the outer circumferential face of the claws 93 is in contact with the inner circumferential face at the front end portion of the cylindrical portion 71 of the secondary hammer 7. The pair of claws 93 serve the function of holding the center of rotation when the secondary hammer 7 rotates. Note that the claws 93 of the anvil 9 and the claws 63 of the primary hammer 6 may not be necessarily provided in a pair (two each), and three or more each of these claws may be provided at equal intervals in the circumferential direction of the anvil 9 and the primary hammer 6 as long as the numbers of the claws are the same.

The anvil 9 has a ring-shaped flange 94 formed so as to be in contact with the pair of claws 93. The ring-shaped cover 25 is disposed on the outer circumferential side of the flange 94 so as to cover the front open end of the cylindrical portion 71 of the secondary hammer 7. An O-ring 19 is disposed between the cover 25 and the slide bearing 26, and the cover 25 is biased to the secondary hammer 7 such that no gap is produced between the cover 25 and the secondary hammer 7.

<Coincidence of Rotational Axes>

Here, the coincidence of the rotational axes of the spindle 5, the primary hammer 6, the secondary hammer 7, and the anvil 9 will be described. As described above, the spindle 5 is rotatably supported on the housing 21 via the ball bearing 27, and the anvil 9 is rotatably supported on the clutch case 22 via the slide bearing 26. Further, the columnar projecting portion 52 formed at the tip of the spindle 5 is fitted in the rotatable state into the hole 92 formed at the rear portion of the anvil 9.

The rear portion of the spindle 5 and the entire anvil 9 are attached to the housing 21 and the clutch case 22 in a state in which their centers of rotation are coincident with each other. Then, by rotatably fitting the projecting portion 52 at the tip of the spindle 5 into the hole 92 of the anvil 9, the spindle 5 and the anvil 9 are coupled to each other in a state in which their rotational axes are coincident with each other and the spindle 5 and the anvil 9 are freely rotatable with respect to each other. With this configuration, the rotational axis of the anvil 9 and the axis O of the spindle 5 can be constantly held in coincidence with each other.

On the other hand, the front portion of the secondary hammer 7 is rotatably supported on the anvil 9 by the inner circumferential face at the front end portion of the cylindrical portion 71 sliding against the outer circumferential face of the pair of claws 93 of the anvil 9. The rear portion of the secondary hammer 7 is rotatably supported on the spindle 5 by the inner circumferential face of the opening 73 formed in the bottom portion 72 sliding against the outer circumferential face of the spindle 5. With this configuration, the rotational axis of the secondary hammer 7 and the axis O of the spindle 5 are constantly held in coincidence with each other.

In a state in which the needle rollers 12 are fitted in the secondary hammer 7, the primary hammer 6 rotates about the same rotational axis as the secondary hammer 7. In this case, the rotational axis of the secondary hammer 7 is constantly coincident with the axis O of the spindle 5, and therefore the primary hammer 6 also rotates about the axis O of the spindle 5.

Next, cushioning members 16, 17, and 18 will be described. As shown in FIG. 1, a ring-shaped cushioning member 16 made of low-repulsion polyurethane rubber is disposed between the stepped portion 74 formed on the outer circumferential side of the bottom portion 72 of the secondary hammer 7 and the ball guide 15, mainly for the purpose of absorbing vibrations.

For the same purpose, cushioning members 17 and 18 made of low-repulsion polyurethane rubber are also disposed between the rear end face of the anvil 9 and each of the end face of a bulged portion 75 formed at the bottom portion 72 of the secondary hammer 7 and the stepped portion 54 of the spindle 5 (see FIG. 2). By disposing these cushioning members, it is possible to further mitigate vibrations in the direction of the axis O.

Note that low-repulsion rubbers, including, for example, the above-described low-repulsion polyurethane rubber are preferably used as the material of the cushioning members 16, 17, and 18. Beside these, it is possible to use thermoplastic elastomer, resin, fiber, leather or the like that has low-repulsion properties.

<Operation of Impact Wrench>

Figure 4A:
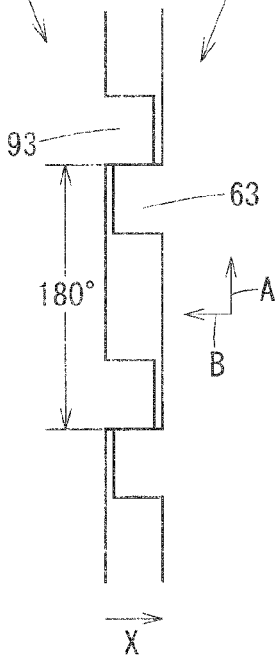
FIG. 4 each schematically show a plane obtained by circumferentially developing the outer circumferential face of the primary hammer and an anvil of the impact wrench shown in FIG. 1.
Figure 4B:
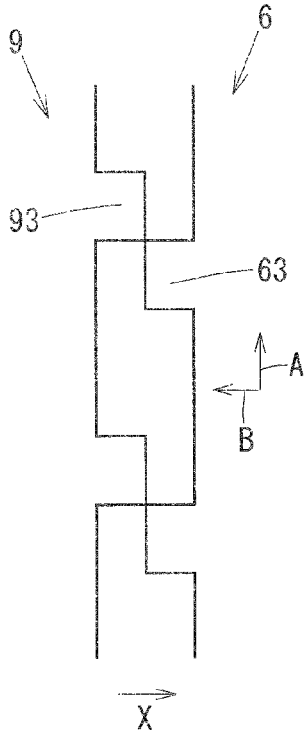
Figure 4C:
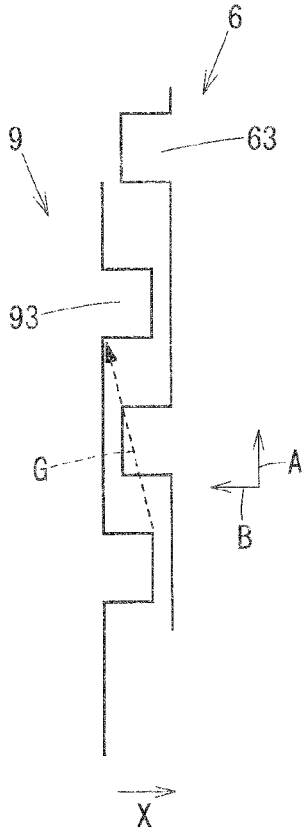

Next, the operation of the impact wrench 1 will be described with reference to FIGS. 1 and 3 described above, and further to FIG. 4. FIG. 4 each schematically show a plane obtained by circumferentially developing the outer circumferential face of the primary hammer 6 and the anvil 9. FIG. 4 are used for describing the state of engagement between the claws 63 of the primary hammer 6 and the claws 93 of the anvil 9.

Upon rotation of the electric motor 3, the rotation is decelerated by the rotation transmission mechanism 4 and then transmitted to the spindle 5, and thereby the spindle 5 rotates at a predetermined number of revolutions. The rotational force of the spindle 5 is transmitted to the primary hammer 6 via the steel balls 11 fitted between the cam grooves 53 of the spindle 5 and the cam grooves 61 of the primary hammer 6.

FIG. 3(*a*) shows the positional relationship between the cam grooves 53 and the cam grooves 61 immediately after the start of tightening a bolt, nut, or the like. FIG. 4(*a*) shows a state of engagement between the claws 63 of the primary hammer 6 and the claws 93 of the anvil 9 at the same point of time. As shown in FIG. 4(*a*), the rotational force A is applied to the primary hammer 6 in the direction indicated by the arrow by rotation of the electric motor 3. The biasing force B in the straight-advancing direction is applied to the primary hammer 6 in the direction indicated by the arrow by the spring 8. Note that although a slight gap exists between the primary hammer 6 and the anvil 9, this gap is produced by the cushioning member 18.

Upon rotation of the primary hammer 6, the engagement between the claws 63 of the primary hammer 6 and the claws 93 of the anvil 9 causes the anvil 9 to rotate, and the rotational force of the primary hammer 6 is transmitted to the anvil 9. Rotation of the anvil 9 causes the socket (not shown) attached to the square end 91 of the anvil 9 to rotate, and thereby initial tightening of a bolt, nut, or the like is performed by application of the rotational force.

When the load torque applied to the anvil 9 increases as the tightening of a bolt, a nut, or the like proceeds, that torque causes the primary hammer 6 to rotate in the Y-direction relative to the spindle 5 as shown in FIG. 3(*a*). Then, the primary hammer 6 overcomes the biasing force B of the spring 8 and moves in the X-direction while the steel balls 11 move in the direction indicated by the arrow F along the inclined faces of the cam grooves 53 and the cam grooves 61.

Then, as shown in FIG. 3(*b*), once the steel balls 11 have moved along the inclined faces of the cam grooves 53 and the cam grooves 61 and the primary hammer 6 has moved in the X-direction correspondingly, the claws 63 of the primary hammer 6 are disengaged from the claws 93 of the anvil 9 as shown in FIG. 4(*b*).

Upon disengagement of the claws 63 of the primary hammer 6 from the claws 93 of the anvil 9, the biasing force B of the compressed spring 8 is released, and thereby the primary hammer 6 advances at high speed in the direction opposite to the X-direction while rotating in the direction opposite to the Y-direction. Then, as shown in FIG. 4(*c*), the claws 63 of the primary hammer 6 move along the track indicated by the arrow G and collide with the claws 93 of the anvil 9, and thereby impact force in the rotational direction is applied to the anvil 9. Thereafter, the claws 63 of the primary hammer 6 move by the reaction in the direction opposite to that of the track G, but is eventually restored in the state shown in FIG. 4(*a*) by exertion of the rotational force A and the biasing force B. By repeating the above-described operation, a rotary impact is repeatedly applied to the anvil 9.

Although the operation for tightening a bolt, nut, or the like has been described above, substantially the same operation as that performed during tightening is performed with the rotary impact mechanism when loosening a tightened bolt or nut. In that case, however, the rotation of the electric motor 3 in the direction opposite to that during tightening causes the steel balls 11 to move to the upper right along the V-shaped grooves 53 shown in FIG. 3(*a*), and the claws 93 of the anvil 9 are struck by the claws 63 of the primary hammer 6 in the direction opposite to that during tightening.

<Action of Secondary Hammer>

Next, the action of the secondary hammer 7 in a rotary impact will be described in comparison with a conventional impact wrench provided with only one hammer.

Upon disengagement between the claws 63 of the primary hammer 6 and the claws 93 of the anvil 9, the spring 8 is released from the compressed state, and the energy accumulated in the spring 8 is released as the kinetic energy of the primary hammer 6 and the secondary hammer 7. As a result of the action between the cam grooves 53 and 61 and the steel balls 11, the primary hammer 6 advances at high speed as indicated by the track G shown in FIG. 4(*c*) while rotating. Then, the claws 63 of the primary hammer 6 collide with the claws 93 of the anvil 9, and thereby impulse in the rotational direction is applied to the anvil 9. Also, the front end face of the primary hammer 6 collides with the rear end face of the anvil 9, and thereby an impulse is applied in the direction of the axis O.

Application of an impact to the anvil 9 by the primary hammer 6 is performed about 10 times per second, and the impulse causes vibrations in a direction orthogonal to the axis of the spindle 5 and in the direction of the axis of the spindle 5. These vibrations cause fatigue to the worker and lead to reduced operation efficiency as well as numbness in the hand, and therefore are desired to be minimized.

Of these vibrations, vibrations in the direction of the axis of the spindle are mainly caused by impulse that is applied in the axial direction by the anvil 9. On the other hand, impulse that is applied in the axial direction by the anvil 9 does not contribute to tightening of bolts, nuts, and the like.

As described above, the strength of impulse generated by a hammer in the direction of the axis O is proportional to the mass of the hammer, and the strength of impulse in the rotational direction is proportional to the moment of inertia (the sum of the products of the mass of each portion of an object and the square of its distance from the rotational shaft) of the hammer. In the case of applying a rotary impact to the anvil 9 with the use of a single hammer, it is necessary to decrease the mass of the hammer in order to reduce the impulse in the direction of the axis O. However, simply decreasing the mass of the hammer results in a reduced moment of inertia and hence a reduced impulse in the rotational direction, and therefore the rotary impact force of the anvil 9 is reduced.

According to the present invention, the above-described problem is solved by using the secondary hammer 7, which is provided separately from the primary hammer 6 fitted to the spindle 5 and rotates together with the primary hammer 6 but does not move in the direction of the axis of the spindle 5. That is, the total mass of the primary hammer 6 and the secondary hammer 7 is substantially equal to the mass in the case of using a single hammer, and is set such that the mass of the secondary hammer 7 is greater than the mass of the primary hammer 6.

In this hammer configuration, the impulsive force that is exerted in the rotational direction of the anvil 9 by releasing the spring 8 from the compressed state is proportional to the moment of inertia of the hammers, or in other words, the total moment of inertia of the primary hammer 6 and the secondary hammer 7. On the other hand, the impulsive force that is applied in the axial direction by the anvil 9 is proportional to the mass of the primary hammer 6 only. Therefore, the impulsive force applied in the axial direction by the anvil 9 can be reduced by increasing the mass of the secondary hammer 7, which contributes only to the impulsive force in the rotational direction, as much as possible compared to the mass of the primary hammer 6.

Furthermore, according to the present invention, the moment of inertia is increased by utilizing the fact that the magnitude of the moment of inertia is proportional to the square of the radius of gyration. That is, the majority of the mass of the cylindrical secondary hammer used in the present invention is concentrated at portions with a larger radius, and therefore the use of the cylindrical secondary hammer provides a larger moment of inertia compared to cases where a columnar secondary hammer, whose mass is concentrated at the center of rotation, is used, and therefore the impulsive force generated by the secondary hammer is increased.

Accordingly, the use of the hammers (the primary hammer 6 and the secondary hammer 7) according to this embodiment makes it possible to achieve an impact wrench 1 in which the impulsive force applied in the rotational direction of the anvil 9 is large and the vibrations generated in the direction of the axis O of the spindle 5 is small.

<Problem of Precession Rotation>

To exert the above-described effect, it is necessary that the primary hammer 6 and the secondary hammer 7 rotate together, and on the other hand, that the primary hammer 6 can smoothly move in the direction of the axis O. In this embodiment, the integral rotation of the primary hammer 6 and the secondary hammer 7 as well as the smooth movement of the primary hammer 6 in the direction of the axis O are achieved by disposing the needle rollers 12 (see FIG. 2) between the primary hammer 6 and the secondary hammer 7.

However, when the secondary hammer 7 undergoes precession rotation because its rotational axis is not coincident with the axis O of the spindle 5, the primary hammer 6 is prevented from moving smoothly in the direction of the axis O and the expected effect cannot be achieved. In the following, the problem of the precession rotation will now be described.

First, the force for tightening bolts, nuts, and the like is reduced. The primary hammer 6 moves forward or backward by sliding on the guide (the needle rollers 12) provided on the inner circumferential face of the secondary hammer 7. As described above with reference to FIG. 4(*c*), when the claws 63 of the primary hammer 6 and the claws 93 of the anvil 9 are disengaged from each other, the spring 8 is released from the compressed state, and the energy accumulated in the spring 8 is released as the kinetic energy of the primary hammer 6 (and partly as the rotational energy of the secondary hammer 7). Then, as a result of action between the cam grooves 53 and 61 and the steel balls 11, the primary hammer 6 rotates while advancing at high speed.

If the secondary hammer 7 undergoes precession rotation at that time, then this acts as a resistance to the forward/backward movement and the rotational movement of the primary hammer 6, resulting in a decrease in the forward speed and the rotational speed. At the same time, the rotational speed of the secondary hammer 7 is also decreased. Then, with a decrease in the rotational speed, the angular acceleration is also decreased. Accordingly, the impulsive torque proportional to the angular acceleration, or in other words, the rotary impact force is decreased, resulting in a decrease in the force for tightening bolts, nuts, and the like.

Second, the wearing of the claws is significant. As shown in the track G in FIG. 4(*c*), in a normal state, the claws 63 of the primary hammer 6 strike the anvil 9 in a state in which they are deeply engaged with the claws 93 of the anvil 9. However, when precession rotation occurs, the movement in the axial direction is relatively slow compared to that caused by rotation of the primary hammer 6 to which the rotational speed of the spindle 5 has been added. Consequently, the claws 93 of the anvil 9 are struck only by the tip of the claws 63 of the primary hammer 6, and the force per unit area applied is excessively large, resulting in significant wearing of both claws.

In this embodiment, precession rotation is prevented by providing the axis holding means for holding the rotational axis of the secondary hammer 7 in coincidence with the axis O of the spindle 5. Specifically, the inside diameter of the opening 73 formed at the center of the bottom portion 72 of the secondary hammer 7 is set to substantially the same size as that of the outside diameter of the columnar portion of the spindle 5 where the cam grooves 53 are located, and the inside diameter at the front end portion of the cylindrical portion 71 is set to the same size as that of the outside diameter of the claws 93 of the anvil 9.

With this configuration, it is possible to make the rotational axis of the secondary hammer 7 constantly coincident with the axis O of the spindle 5, thus enabling the primary hammer 6 to move smoothly in the direction of the axis O. Note that in this embodiment, the hindrance of smooth rotation by friction is prevented by applying grease to the inner circumferential face of the opening 73 of the secondary hammer 7 and the inner circumferential face at the front end portion of the cylindrical portion 71.

<Noise Reduction>

In this embodiment, the secondary hammer 7 also serves the function of reducing the noise generated by an impact between the claws 63 of the primary hammer 6 and the claws 93 of the anvil 9. As shown in FIG. 1, the claws 63 of the primary hammer 6 and the claws 93 of the anvil 9, which are portions where the sound of the impact is generated, are housed in the internal space of the cylindrical portion 71 of the secondary hammer 7. In other words, the portions where the sound of the impact is generated are covered with the cylindrical portion 71 of the secondary hammer 7. Also, the ring-shaped flange 94 is formed at the rear portion of the anvil 9, and the ring-shaped cover 25 is further disposed so as to cover the front open end of the cylindrical portion 71 of the secondary hammer 7.

Accordingly, the portions where the sound of the impact is generated are covered with the spindle 5, the cylindrical portion 71 and the bottom portion 72 of the secondary hammer 7, the flange 94 of the anvil 9, and the cover 25, and thereby leakage of the sound of the impact to the outside can be suppressed.

Although the needle rollers 12 are used as the guide for causing the primary hammer 6 to move in the direction of the axis of the secondary hammer 7 in this embodiment, the present invention is not limited thereto and it is possible to use a long cylindrical roller or cylindrical roller. There is no problem using rollers other than those rollers for roller bearings, as long as the rollers are columnar members. Furthermore, the outer circumferential face of the primary hammer 6 and the inner circumferential face of the secondary hammer 7 may be splined and engaged with each other thereby to cause the primary hammer 6 to move in the direction of the axis of the secondary hammer 7.

Although the anvil 9 is provided with the flange 94 and the front open end of the cylindrical portion 71 of the secondary hammer 7 is covered with the flange 94 and the cover 25 in this embodiment, the front open end of the cylindrical portion 71 may be covered with a cover 25 having a center opening with substantially the same inside diameter as the outside diameter of the columnar portion of the anvil 9 that is located behind the square end 91, without providing the anvil 9 with a flange.

Although steel is used as the material for the secondary hammer in this embodiment, the use of a metal having a larger specific gravity than that of steel, such as copper, or an alloy thereof to form a secondary hammer can further increase the rotary impact force.

(Embodiment 2)

Figure 5:
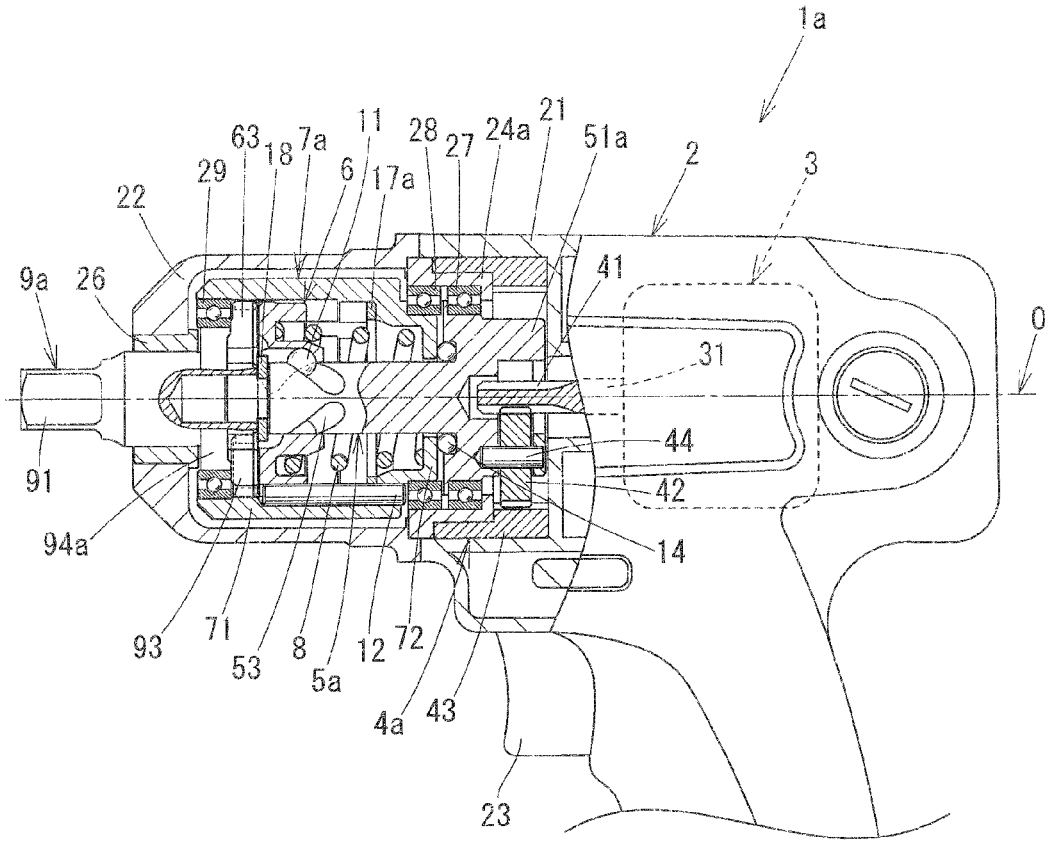
FIG. 5 is an elevation showing principal parts of an impact wrench according to Embodiment 2 of the present invention, cut in a longitudinal plane including the axis of a spindle.

FIG. 5 is an elevation showing principal parts of an impact wrench according to Embodiment 2 of the present invention, cut in a longitudinal plane including the axis of a spindle. An impact wrench 1*a* according to Embodiment 2 is different from the impact wrench 1 according to Embodiment 1 with regard to the configuration of the axis holding means for holding the rotational axis of the secondary hammer in coincidence with the axis of the spindle. Therefore, the spindle 5, the secondary hammer 7, and the anvil 9 of Embodiment 1 are replaced by a spindle 5*a*, a secondary hammer 7*a*, and an anvil 9*a*.

In the following, the configuration and the operation of the impact wrench 1*a* will be described, focusing on the configuration of the axis holding means. Note that in FIG. 5, components having the same functions as those of the impact wrench 1 in FIG. 1 are denoted by the same reference numerals and the description thereof is omitted.

In Embodiment 1, the rotational axis of the secondary hammer 7 is made coincident with the axis O of the spindle 5 by means of the opening 73 formed in the bottom portion 72 of the secondary hammer 7 and the claws 93 of the anvil 9. On the other hand, in this embodiment, the rotational axis of the secondary hammer 7*a* is made coincident with the axis O of the spindle 5*a* by means of a bush 24*a* fixed to the housing 21 and a flange 94*a* provided at the rear portion of the anvil 9*a*.

Specifically, the rear end portion of the secondary hammer 7*a* is supported in the rotatable state on the housing 21 by a ball bearing 28 that is attached to the housing 21 via the cylindrical bush 24*a*. Further, the inner circumferential face at the front end portion of the cylindrical portion 71 of the secondary hammer 7*a* is attached via a ball bearing 29 to the flange 94*a* provided at the rear portion of the anvil 9*a*, and thereby the front end portion of the cylindrical portion 71 of the secondary hammer 7*a* is supported in the rotatable state on the anvil 9*a*.

Therefore, the shape of the spindle 5*a* and the shape of the anvil 9*a* are slightly changed. As for the spindle 5*a*, a thick bulged portion 51*a* is formed at the rear end portion and the ball bearing 27 is disposed on the outer circumferential face of the bulged portion 51*a*. Then, a structure is adopted in which the ball bearing 27 is supported integrally with the ball bearing 28 for the secondary hammer 7*a* by means of the cylindrical bush 24*a* described above.

By supporting the ball bearing 27 for the spindle 5*a* and the ball bearing 28 for the secondary hammer 7*a* by a single cylindrical bush 24*a* in this manner, it is possible to make the center of rotation of the rear portion of the secondary hammer 7*a* coincident with the axis O of the spindle 5*a*.

On the other hand, the flange 94*a* of the anvil 9*a* is formed to have a larger thickness than that of the flange 94 of the anvil 9 of Embodiment 1 and the ball bearing 29 is further fitted in the outer circumferential face of the flange 94*a*. As with Embodiment 1, the anvil 9*a* is supported rotatably on the clutch case 22 via the slide bearing 26 and the rotational axis of the anvil 9*a* is coincident with the axis O of the spindle 5*a*.

Although the inner circumferential face of the cylindrical portion 71 of the secondary hammer 7 is supported by the outer circumferential face of the pair of claws 93 of the anvil 9 in Embodiment 1, the inner circumferential face of the cylindrical portion 71 of the secondary hammer 7*a* is supported by the entire outer circumferential face of the flange 94*a* in this embodiment. Accordingly, this embodiment is more effective in making the center of rotation of the front portion of the secondary hammer 7*a* coincident with the axis O of the spindle 5*a*.

As the result of the foregoing, the secondary hammer 7*a* is attached to the bush 24*a* via the ball bearing 28 and attached to the anvil 9*a* via the ball bearing 29, in a state in which the rotational axis thereof is coincident with the axis O of the spindle 5*a*.

Note that a ring-shaped groove is formed at the basal portion of the bulged portion 51*a* of the spindle 5*a*, and a plurality of steel balls 14 are disposed between the groove and the bottom portion 72 of the secondary hammer 7*a*. Rotation of the balls 14 enables the secondary hammer 7*a* to rotate freely on the spindle 5*a*.

Although the inner circumferential face of the cylindrical portion 71 of the secondary hammer 7*a* is supported by the flange 94*a* of the anvil 9*a* via the ball bearing 29 in this embodiment, this support may not necessarily be through the ball bearing 29. The inner circumferential face of the cylindrical portion 71 of the secondary hammer 7*a* may be supported directly by the outer circumferential face of the flange 94*a*, as long as sufficient sliding properties can be ensured.

As with the flange 94 and the cover 25 in Embodiment 1, the flange 94*a* of the anvil 9*a* in this embodiment seals the front open end of the cylindrical portion 71 of the secondary hammer 7*a* and thus can suppress leakage of the sound of the impact to the outside. However, when the secondary hammer 7*a* is supported via the ball bearing 29, complete sealing cannot be provided since there is a gap in the ball bearing 29. A better noise reducing effect is achieved by directly supporting the inner circumferential face of the cylindrical portion 71 of the secondary hammer 7*a* by the outer circumferential face of the flange 94*a* without providing the ball bearing 29.

In this embodiment, rotation of the electric motor 3 is transmitted to the spindle 5*a* by the rotation transmission mechanism 4*a* using three planetary gears 42, which is different from the rotation transmission mechanism 4 using two planetary gears 42 in Embodiment 1. However, the number of the planetary gears 42 can be suitably changed according to the strength of teeth or the like, and this difference is not essential.

(Embodiment 3)

Figure 6:
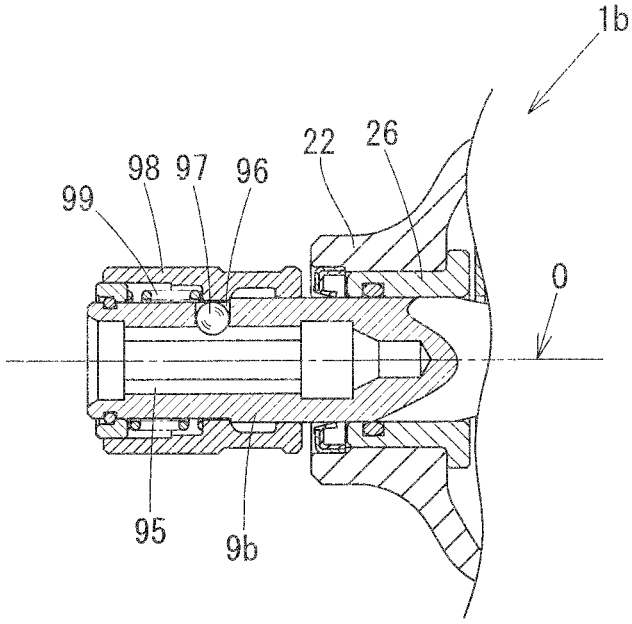
FIG. 6 is a cross-sectional view of a front portion of an impact wrench according to Embodiment 3 of the present invention in which an anvil with a driver bit insertion hole is used.

Although the impact wrenches 1 using the anvils 9 and 9*a* for tightening bolts, nuts, or the like are described in Embodiments 1 and 2 above, it is also possible to provide an impact wrench that can be used as an impact wrench for tightening machine screws such as a slotted-head screw and a cross recessed screw, with the use of an anvil having a hole formed at its tip portion for insertion of a hex bit, which is a driver bit. FIG. 6 is a cross-sectional view of the front portion of an impact wrench 1*b* according to Embodiment 3 of the present invention, in which an anvil 9*b* having a hole for insertion of a hex bit is used in place of the anvil 9 of the impact wrench 1 shown in FIG. 1.

A bit insertion hole 95 for removable attachment of a hex bit is formed at the front portion of the anvil 9*b* along the axis O. A steel ball 97 for engagement with a groove provided on a hex bit is inserted into an opening 96 formed in the outer circumferential face of the anvil 9*b*.

To insert a hex bit into the bit insertion hole 95, a cylindrical steel ball holder 98 fitted on the outer circumferential side of the anvil 9*b* is moved forward against the force of a spring 99, thus enabling the steel ball 97 to move radially outward.

At the stage at which the insertion of the hex bit into the bit insertion hole 95 has been completed, bringing the steel ball holder 98 to its original position causes the steel ball 97 to move in the direction of the radial center and then to be engaged with the groove of the hex bit, thus preventing the detachment of the hex bit from the bit insertion hole 95.

With the use of the hammer configuration (the primary hammer 6, the secondary hammers 7, 7*a*) described in Embodiments 1 and 2 for the impact wrench 1*b* according to this embodiment in which the anvil 9*b* is attached, it is possible to reduce the vibrations in the direction of the axis O that occur during tightening of a machine screw or the like.

As described thus far, in the impact wrench according to the present invention, the hammers are composed of a primary hammer fitted to the outer circumference of a spindle and a cylindrical secondary hammer that is disposed so as to cover the primary hammer and that rotates together with the primary hammer. Furthermore, the secondary hammer is held by a axis holding means in a state in which its rotational axis is coincident with the axis of the spindle in order to prevent precession movement. With the use of the hammer configuration of the present invention, it is possible to reduce the mass of the primary hammer compared to the mass of the secondary hammer, and mitigate vibrations that occur in the direction of the axis of the spindle, while maintaining the rotary impact force. Consequently, it is possible to reduce the fatigue of the worker and prevent a reduction in the operation efficiency and the occurrence of numbness.

Although the opening formed at the center of the bottom portion of the secondary hammer, the claws and the flange that are formed on the anvil, and also the bushes and the like that are fixed to the housing are used as the axis holding means in the above-described embodiments, it is needless to say that the present invention is not limited thereto. For example, the precession rotation of the secondary hammer may be prevented by forming the cylindrical bulged portion at the flange of the anvil so as to over the claws provided at the rear portion of the anvil, and engaging the inner circumferential face of the bulged portion with the outer circumferential face of the cylindrical portion of the secondary hammer.

Although cases where an electric motor is used as the motor for causing the spindle to rotate are described in the above-described embodiments, it is needless to say that the same effect can also be achieved with the use of an air motor.

Ball bearings are used as the bearings for rotatably supporting the secondary hammer in Embodiment 2 described above, the present invention is not necessarily limited thereto. Modifications, including, for example, the use of roller bearings or slide bearings, can be suitably made according to the required specifications.

Industrial Applicability

The impact wrench according to the present invention can mitigate vibrations in the axial direction during the tightening operation and can reduce the fatigue of the worker, and therefore is particularly effective when used as a large wrench that requires a large tightening force and a wrench for an application in which the tightening operation is continuously performed.

Descriptions of Reference Numerals

1, 1*a*, 1*b* Impact wrench
2 Case
3 Electric motor
4, 4*a* Rotation transmission mechanism
5 Spindle
6 Primary hammer
7, 7*a* Secondary hammer
8, 99 Spring
9, 9*a*, 9*b* Anvil
11, 97 Steel ball
12 Needle roller
13 Washer
14 Ball
15 Ball guide
16, 17, 18 Cushioning member
21 Housing
22 Clutch case
24, 24*a* Bush
25 Cover
26 Slide bearing
27, 28, 29 Ball bearing
31 Rotational shaft
51, 51*a* Bulged portion
53, 61 Cam groove
63, 93 Claw
71 Cylindrical portion
72 Bottom portion
91 Square end
94, 94*a* Flange
95 Bit insertion hole
98 Steel ball holder

The invention claimed is:

1. An impact wrench comprising:

a columnar spindle that can be rotated by a motor;

an anvil that is disposed forward in a direction of a rotational axis of the spindle and whose rotational axis is coincident with said axis of the spindle, the anvil including, at a front portion thereof, a square shank portion to which a tightening socket can be mounted or a hole into which a driver bit can be inserted, and including a first claw at a rear portion thereof;

a primary hammer that can be fitted to an outer circumference of the spindle and that includes, at a front portion thereof, a second claw for engagement with the first claw, the primary hammer being capable of rotating about the rotational axis of the spindle and of moving in the direction of said axis;

a secondary hammer including a cylindrical portion that rotates integrally with the primary hammer, the cylindrical portion having an internal space into which the spindle can be inserted and in which the primary hammer can be housed;

a rotary impact mechanism that is interposed between the spindle and the primary hammer, that causes, when a torque greater than a predetermined value is exerted between the spindle and the primary hammer, the primary hammer to rotate and advance in a direction of the anvil, and that strikes the first claw by engaging impulsively the second claw with the first claw, thereby causing the anvil to rotate about an axis;

a center holding means that holds the rotational axis of the secondary hammer in coincidence with the rotational axis of the spindle; and a case that houses at least the spindle, the anvil, the primary hammer, and the secondary hammer, and that has an opening from which the front portion of the anvil projects, wherein the spindle and the secondary hammer are rotatably supported on the case via a first bearing and a second bearing, respectively, in a state in which axes of the spindle and the secondary hammer are coincident so that the case functions as the center holding means, and wherein the first bearing and the second bearing are attached to an inner circumferential face of a cylindrical bush and the bush is fixed to the case.

2. An impact wrench comprising:

a columnar spindle that can be rotated by a motor;

an anvil that is disposed forward in a direction of a rotational axis of the spindle and whose rotational axis is coincident with said axis of the spindle, the anvil including, at a front portion thereof, a square shank portion to which a tightening socket can be mounted or a hole into which a driver bit can be inserted, and including a first claw at a rear portion thereof;

a primary hammer that can be fitted to an outer circumference of the spindle and that includes, at a front portion thereof, a second claw for engagement with the first claw, the primary hammer being capable of rotating about the rotational axis of the spindle and of moving in the direction of said axis;

a secondary hammer including a cylindrical portion that rotates integrally with the primary hammer, the cylindrical portion having an internal space into which the spindle can be inserted and in which the primary hammer can be housed;

a rotary impact mechanism that is interposed between the spindle and the primary hammer, that causes, when a torque greater than a predetermined value is exerted between the spindle and the primary hammer, the primary hammer to rotate and advance in a direction of the anvil, and that strikes the first claw by engaging impulsively the second claw with the first claw, thereby causing the anvil to rotate about an axis;

a center holding means that holds the rotational axis of the secondary hammer in coincidence with the rotational axis of the spindle; and a case that houses at least the spindle, the anvil, the primary hammer, and the secondary hammer, and that has an opening from which the front portion of the anvil projects, wherein the spindle and the secondary hammer are rotatably supported on the case via a first bearing and a second bearing, respectively, in a state in which axes of the spindle and the secondary hammer are coincident so that the case functions as the center holding means, and wherein the first bearing and the second bearing are attached to an inner circumferential face of a cylindrical bush and the bush is fixed to the case.

3. The impact wrench according to claim 2, wherein an inner circumferential face of the cylindrical portion of the secondary hammer is rotatably supported by an outer circumferential face of at least two first claws provided at the anvil, so that the first claws of the anvil function as the center holding means.

4. The impact wrench according to claim 3, wherein a bottom portion of the cylindrical secondary hammer is formed at a rear end portion of the cylindrical portion, and an opening through which the spindle passes is formed at the center of the bottom portion, and the internal space of the cylindrical portion of the secondary hammer is configured to be sealed by the bottom portion of the secondary hammer, a ring-shaped flange formed at the rear portion of the anvil, and a ring-shaped cover disposed between a front open end of the cylindrical portion and the flange.

5. The impact wrench according to claim 2, wherein an inner circumferential face of the cylindrical portion of the secondary hammer is supported directly or via a third bearing by a ring-shaped flange provided at the rear portion of the anvil, so that the flange functions as the center holding means.

6. The impact wrench according to claim 2, wherein a plurality of first grooves that have a semi-circular cross-sectional shape and are parallel to the axis of the spindle are formed on an outer circumferential face of the primary hammer, a plurality of second grooves that have a semi-circular cross-sectional shape and are parallel to the axis of the spindle are formed on an inner circumferential face of the cylindrical portion of the secondary hammer at positions corresponding to the first grooves, and a columnar member is fitted in each of the first grooves and the second grooves.

7. The impact wrench according to claim 2, wherein a bottomed cylindrical secondary hammer in which a bottom portion is formed at a rear end portion of the cylindrical portion and an opening through which the spindle passes is formed at the center of the bottom portion is used as the secondary hammer, and a spring that biases the primary hammer in the direction of the anvil is disposed between the bottom portion of the secondary hammer and the primary hammer.

8. The impact wrench according to claim 2, wherein a ring-shaped cushioning member for absorbing shock is disposed between a stepped portion formed at the front portion of the spindle and a rear end portion of the anvil.

9. The impact wrench according to claim 2, wherein the rotary impact mechanism further comprises at least one groove formed on an inner circumferential surface of the primary hammer, each of the at least one groove on the inner circumferential surface of the primary hammer having an end portion with a V-shape.

10. The impact wrench according to claim 9, wherein the rotary impact mechanism further comprises at least one ball each sandwiched between a respective one of the at least one groove formed on the outer circumferential surface of the spindle and a respective one of the at least one groove formed on the inner circumferential surface of the primary hammer.

11. The impact wrench according to claim 10, wherein movement of the at least one ball along the at least one groove formed on the outer circumferential surface of the spindle and the at least one groove formed on the inner circumferential surface of the primary hammer allows the primary hammer to rotate while moving forward or backward along the outer circumferential face of the spindle.

12. The impact wrench according to claim 9, wherein the at least one groove formed on the outer circumferential surface of the spindle consists of two grooves and the at least one groove formed on the inner circumferential surface of the primary hammer consists of two grooves.

13. The impact wrench according to claim 12, wherein the rotary impact mechanism further comprises two balls each sandwiched between a respective one of the two grooves formed on the outer circumferential surface of the spindle and a respective one of the two grooves formed on the inner circumferential surface of the primary hammer.

14. The impact wrench according to claim 2, wherein the rotary impact mechanism further comprises a biasing member that biases the primary hammer in a direction of the anvil.

15. An impact wrench comprising:

a columnar spindle that can be rotated by a motor;

an anvil that is disposed forward in a direction of a rotational axis of the spindle and whose rotational axis is coincident with said axis of the spindle, the anvil including, at a front portion thereof, a square shank portion to which a tightening socket can be mounted or a hole into which a driver bit can be inserted, and including a first claw at a rear portion thereof;

a primary hammer that can be fitted to an outer circumference of the spindle and that includes, at a front portion thereof, a second claw for engagement with the first claw, the primary hammer being capable of rotating about the rotational axis of the spindle and of moving in the direction of said axis;

a secondary hammer including a cylindrical portion that rotates integrally with the primary hammer, the cylindrical portion having an internal space into which the spindle can be inserted and in which the primary hammer can be housed;

a rotary impact mechanism that is interposed between the spindle and the primary hammer, that causes, when a torque greater than a predetermined value is exerted between the spindle and the primary hammer, the primary hammer to rotate and advance in a direction of the anvil, and that strikes the first claw by engaging impulsively the second claw with the first claw, thereby causing the anvil to rotate about an axis, the rotary impact mechanism comprising at least one groove formed on an inner circumferential surface of the primary hammer, each of the at least one groove having a rearward axial end portion with a V-shape;

a center holding means that holds the rotational axis of the secondary hammer in coincidence with the rotational axis of the spindle; and a case that houses at least the spindle, the anvil, the primary hammer, and the secondary hammer, and that has an opening from which the front portion of the anvil projects, wherein the spindle and the secondary hammer are rotatably supported on the case via a first bearing and a second bearing, respectively, in a state in which axes of the spindle and the secondary hammer are coincident so that the case functions as the center holding means the first bearing and the second bearing are attached to an inner circumferential face of a cylindrical bush and the bush I is fixed to the case.

16. The impact wrench according to claim 15, wherein the at least one groove consists of two grooves.

* * * * *